US006668141B2

(12) United States Patent
Kojima et al.

(10) Patent No.: US 6,668,141 B2
(45) Date of Patent: Dec. 23, 2003

(54) IMAGE FORMING APPARATUS, CARTRIDGE, IMAGE FORMING SYSTEM, AND A MEMORY DEVICE FOR DETERMINING THE AMOUNT OF DEVELOPER IN A DEVELOPER CONTAINING PORTION

(75) Inventors: Katsuhiro Kojima, Shizuoka (JP); Hideki Matsumoto, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/951,431

(22) Filed: Sep. 14, 2001

(65) Prior Publication Data

US 2002/0057918 A1 May 16, 2002

(30) Foreign Application Priority Data

Sep. 19, 2000 (JP) ..... 2000-284367

(51) Int. Cl.[7] ..... G03G 13/04
(52) U.S. Cl. ..... 399/27; 399/61
(58) Field of Search ..... 399/12, 13, 24, 399/25, 27, 29, 30, 61, 62, 63, 64

(56) References Cited

U.S. PATENT DOCUMENTS 6,343,193 B1 * 1/2002 Matsumoto et al. ..... 399/27
6,476,837 B2 * 11/2002 Ogata ..... 399/27

FOREIGN PATENT DOCUMENTS

WO WO 01/44240 A1 6/2001 ..... C07D/417/12

OTHER PUBLICATIONS

Li J et al., Improved method for the synthesis of 4–'2–(methyl–2–pyridinylamino) ethoxy ! benzaldehyde, vol. 134, No. 20, p. 684 May 14, 2001(Abstract) [ XP–00 2187 086].
Cantello B C C et. al, Journal of medicinal chemistry, vol37, No. 23, 1994, pp. 3977–3985 [ XP– 00 2127 002].
Cantello B C C et al., Bioorganic & Medicinal chemistry, vol3, No. 10,1994, pp. 1181–1184 [ XP—00 105 2838 ].
Abarbri M et. Al, Helvetica Chimica Acta, vol. 78, no1, Feb. 8, 1995, pp. 109–121[ XP– 00218 7084 ].
Reddy K A et. al., Journal of Medicinal Chemistry, vol42, no 17, Aug. 26, 1999, pp. 3265–3278 [ XP—00 218 7085 ].
International Search Report on corresponding PCT application No. PCT/IB 01/01367 Filed on Jul. 30, 2001.

* cited by examiner

*Primary Examiner*—Hoang Ngo
(74) *Attorney, Agent, or Firm*—Fitzpatrick, Cella, Harper & Scinto

(57) ABSTRACT

In an electrophotographic image forming apparatus to which a cartridge containing a developer therein is detachably attachable, the cartridge has a memory storing therein information regarding the cartridge, and the main body of the apparatus is of a construction which has two or more devices for relating the output of a developer remaining amount detector and the developer amount to each other, and determines the method for relating the output of the developer remaining amount detector used to detect the developer amount from the output of the developer remaining amount detector and the developer amount to each other, on the basis of the information regarding the cartridge stored in the memory.

11 Claims, 8 Drawing Sheets

IMAGE FORMING APPARATUS, CARTRIDGE, IMAGE FORMING SYSTEM, AND A MEMORY DEVICE FOR DETERMINING THE AMOUNT OF DEVELOPER IN A DEVELOPER CONTAINING PORTION

BACKGROUND OF THE INVENTION

1. Field of the Invention

This invention generally relates to an image forming apparatus using the electrophotographic process, a cartridge detachably attachable to this image forming apparatus, i.e., a process cartridge, and a developing apparatus made into a cartridge, and particularly to an image forming apparatus, a cartridge and an image forming system in which the remaining amount of developer is detected by the use of storing means carried on the cartridge.

The term "electrophotographic image forming apparatus" covers, for example, an electrophotographic copier, an electrophotographic printer (such as an LED printer or a laser beam printer) and an electrophotographic facsimile apparatus.

The cartridge detachably attachable to the main body of the electrophotographic image forming apparatus refers to one having at least one of an electrophotographic photosensitive body, charging means for charging the electrophotographic photosensitive body, developing means for supplying a developer to the electrophotographic photosensitive body, and cleaning means for cleaning the electrophotographic photosensitive body.

Particularly, the process cartridge refers to at least one of charging means, developing means and cleaning means and an electrophotographic photosensitive body integrally made into a cartridge which is made detachably attachable to the main body of the electrophotographic image forming apparatus, or at least developing means and an electrophotographic photosensitive body integrally made into a cartridge which is made detachably attachable to the main body of the electrophotographic image forming apparatus.

2. Related Background Art

In an image forming apparatus of the electrophotographic type such as an electrophotographic copier or a laser beam printer, light corresponding to image information is applied to an electrophotographic photosensitive body to thereby form a latent image thereon, and a developer is supplied to this latent image by the use of developing means to thereby visualize the latent image, and further the image is transferred from the photosensitive body to a recording medium to thereby form an image on the recording medium. A developer containing container is connected to the developing means, and the developer is consumed by the image being formed.

In such image forming apparatuses, with a view to achieving the simplicity of the interchange and maintenance of such expendibles as an electrophotographic photosensitive body and a developer, there is a process cartridge system in which the electrophotographic photosensitive body, developing means, charging means and cleaning means as process means for acting on the electrophotographic photosensitive body and further, a developer containing container, a waste developer container, etc. are made integral as a process cartridge, which is made detachably attachable to the main body of the image forming apparatus. According to this process cartridge system, the maintenance of the apparatus can be done by a user himself without resorting to a serviceman and therefore, operability can be markedly improved. So, this process cartridge system is widely used in the electrophotographic image forming apparatuses.

Also, as a color image forming apparatus having, for example, developing means of a plurality of colors, there is one in which each developing means and a developer containing container are made into a cartridge which is made detachably attachable to the image forming apparatus and individually interchangeable.

In these image forming apparatuses of the cartridge type, the user can interchange the cartridge, for example, at a point of time whereat the developer has run short, to thereby form an image again. Therefore, in some cases, such an image forming apparatus is provided with means for detecting the consumption of the developer and informing the user of it, i.e., a developer amount detecting apparatus.

The developer amount detecting apparatus has in the cartridge or the main body of the image forming apparatus developer remaining amount detecting means capable of detecting the developer remaining amount level in order to enable the user to know at any time how much of the developer usable for image formation remains in the cartridge. Particularly, if the user can be informed not only of the fact that the developer has run short, but also of the amount of developer as it is sequentially detected, the convenience to the user can be further improved.

As this developer remaining amount detecting means, there is a capacitance measuring system provided with at least one pair of input side and output side electrodes, and measuring the capacitance between the two electrodes to thereby detect the amount of developer. As such a system, there is a plate antenna system. This plate antenna system utilizes a structure such that when there is adopted, for example, a developing method of applying an AC bias to a developer carrying member provided in the developing means to thereby develop a latent image formed on an electrophotographic photosensitive body, a metal plate or plates are provided at a location opposed to the developer carrying member or a plurality of other locations, and a capacitance between the metal plate and the developer carrying member and between these metal plates changes in conformity with the amount of the developer which is an insulative toner or the like.

That is, if the space between the metal plate and the developer carrying member or between the metal plates is filled with the developer, the capacitance therebetween becomes great, and as the developer decreases, the rate at which air occupies the space between the two increases, and the capacitance becomes smaller. Accordingly, by relating in advance the relation between the capacitance between the metal plate and the developer carrying member or the capacitance between the metal plates as a table, the developer amount level can be detected by measuring the capacitance. The measurement of the capacitance can be accomplished by measuring, when an AC bias is applied to the developer carrying member and the metal plate which is an electrode, an electric current flowing through the other metal plate. That is, in the developer remaining amount detecting means of this type, the developer amount is often detected during image formation during which a developing bias is applied to the developer carrying member.

However, even if as described above, provision is made of the developer remaining amount detecting means capable of detecting the developer remaining amount level, there may arise the problem that if use is made of a process cartridge in which, for example, the disposition of the metal plate which is an electrode, or the amount of the developer in the cartridge during the non-use thereof (developer capacity) differs, when the developer remaining amount level is detected by only a preset table, it widely differs from the developer amount actually remaining in the developing apparatus.

SUMMARY OF THE INVENTION

Accordingly, it is an object of the present invention to provide an image forming apparatus, a cartridge and an image forming system in which for a cartridge usable in the image forming apparatus, the developer amount can always be detected highly accurately and the user can be informed of an accurate developer amount and an appropriate cartridge interchange time, whereby good images can always be formed.

According to another embodiment of the present invention, there are provided an image forming apparatus, a cartridge and an image forming system in which for a plurality of kinds of cartridges usable in the image forming apparatus and differing, for example, in developer capacity or the like from one another, the developer amount can always be detected highly accurately and the unevenness of the result of the detection of the developer amount due to the individual difference of the cartridges or the image forming apparatus can be prevented.

The above object is achieved by the image forming apparatus, the cartridge and the image forming system according to the present invention. Summing up, according to a first invention, there is provided an image forming apparatus having a developer containing portion and developer remaining amount detecting means capable of sequentially putting out an output conforming to the developer amount in the developer containing portion, wherein the cartridge has storing means storing therein information regarding the cartridge, the main body of the apparatus has two or more means for relating the output of the developer remaining amount detecting means and the developer amount to each other, and the relating of the output of the developer remaining amount detecting means used to detect the developer amount and the developer amount to each other is determined on the basis of the information regarding the cartridge stored in the storing means.

According to an embodiment of the first invention, the means for relating the output of the developer remaining amount detecting means and the developer amount to each other are a table for making the output of the developer remaining amount detecting means and the developer amount homologize to each other.

Also, according to an embodiment of the present invention, the table is a table for making the amount of change in the output value of the developer remaining amount detecting means when the developer remaining amount detecting means detects the maximum of the developer amount and the developer amount homologize to each other.

According to another embodiment of the first invention, the information regarding the cartridge is information regarding at least the output characteristic of the developer remaining amount detecting means and capable of discriminating the kind of the cartridge.

According to another embodiment, the information regarding the cartridge is information regarding the output value when the developer remaining amount detecting means detects the maximum of the developer amount and capable of discriminating the kind of the cartridge. Also, according to another embodiment, the information regarding the cartridge is developer amount information in the unused state of the cartridge.

According to another embodiment of the first invention, the storing means further stores therein information corresponding to the output value when the developer remaining amount detecting means detects the maximum of the developer amount.

According to another embodiment of the first invention, the main body of the apparatus further has display means, and transmits a signal for displaying information regarding the detected developer amount to this display means and displays it thereon.

Also, according to another embodiment of the present invention, the main body of the apparatus is further capable of communicating with a device having display means, and transmits a signal for displaying the information regarding the detected developer amount to the device having this display means.

According to a second embodiment, there is provided a cartridge having a developer containing portion, developer remaining amount detecting means capable of sequentially putting out an output conforming to the developer amount in the developer containing portion, and storing means storing therein information regarding the cartridge.

According another embodiment of the second invention, the information regarding the cartridge is information regarding at least the output characteristic of the developer remaining amount detecting means and capable of discriminating the kind of the cartridge.

According to another embodiment, the information regarding the cartridge is information regarding the output value when the developer remaining amount detecting means detects the maximum of the developer amount and capable of discriminating the kind of the cartridge.

Also, according to another embodiment, the information regarding the cartridge is developer amount information in the unused state of the cartridge.

According to another embodiment of the second invention, the storing means further stores therein information corresponding to the output value when the developer remaining amount detecting means detects the maximum of the developer amount.

According to a third invention, there is provided an image forming system having (a) a cartridge having a developer containing portion, developer remaining amount detecting means capable of sequentially putting out an output conforming to the developer amount in the developer containing portion, and storing means storing therein information regarding the cartridge, and (b) two or more means for relating the output of the developer remaining amount detecting means and the developer amount to each other, characterized by control means for determining the means for relating the output of the developer remaining amount detecting means used to detect the developer amount and the developer amount to each other on the basis of the information regarding the cartridge stored in the storing means.

According to an embodiment of the third invention, the image forming system further has display means for displaying information regarding the detected developer amount.

In each of the above-described inventions, according to an embodiment, as the developer remaining amount detecting means, use is made of one outputted signal obtained by measuring the capacitance between electrodes.

Also, according to an embodiment of each of the above-described inventions, as the storing means, use can be made of a nonvolatile memory, a non-contact type nonvolatile memory or a volatile memory provided with a power supply.

Also, in each of the above-described inventions, the cartridge further has at least one of an electrophotographic photosensitive body, charging means for charging the electrophotographlc photosensitive body, developing means for supplying a developer to the electrophotographic photosensitive body, and cleaning means for cleaning the electrophotographic photosensitive body.

According to the present invention, in a cartridge having a developer containing portion and developer remaining amount detecting means capable of sequentially putting out an output conforming to the developer amount in the developer containing portion, an image forming apparatus to which this cartridge is detachably attachable, and an image forming system using this cartridge, the cartridge has storing means storing therein information regarding the cartridge, and the main body of the apparatus is of a construction which has two or more means for relating the output of the developer remaining amount detecting means and the developer amount to each other, and determines the means for relating the output of the developer remaining amount detecting means used to detect the developer amount and the developer amount to each other, on the basis of the information regarding the cartridge stored in the storing means and therefore, for the cartridge usable in the image forming apparatus, the developer amount can always be detected with high accuracy and the user can be informed of an accurate developer amount. Accordingly, it is possible to let the user know an appropriate cartridge interchanging time to thereby always form good images.

Also, according to the present invention, it is possible to adopt a construction which stores information corresponding to the detected value when the developer remaining amount detecting means has detected the maximum of the developer amount, and uses it to detect the developer amount and therefore, for a plurality of kinds of cartridges usable in the image forming apparatus and differing, for example, in developer capacity or the like from one another, the developer amount can always be detected with high accuracy and the unevenness of the result of the detection of the developer amount due to the individual difference of the cartridge or the image forming apparatus can be prevented.

These and other objects, features and advantages of the present invention will become more apparent upon consideration of the following description of the preferred embodiments of the present invention taken in conjunction with the accompanying drawings.

DESCRIPTION OF THE PREFERRED EMBODIMENTS

An image forming apparatus, a cartridge and an image forming system according to the present invention will hereinafter be described in greater detail with reference to the drawings.

Embodiment 1

The image forming system of this embodiment is such that a laser beam printer (printer) 100 which is an electrophotographic image forming apparatus receives image information from a host computer (not shown), and forms an image on a recording medium such as recording paper, an OHP sheet or cloth by the electrophotographic image forming process by the use of a process cartridge B detachably attached to the main body A of the image forming apparatus.

Figure 1:
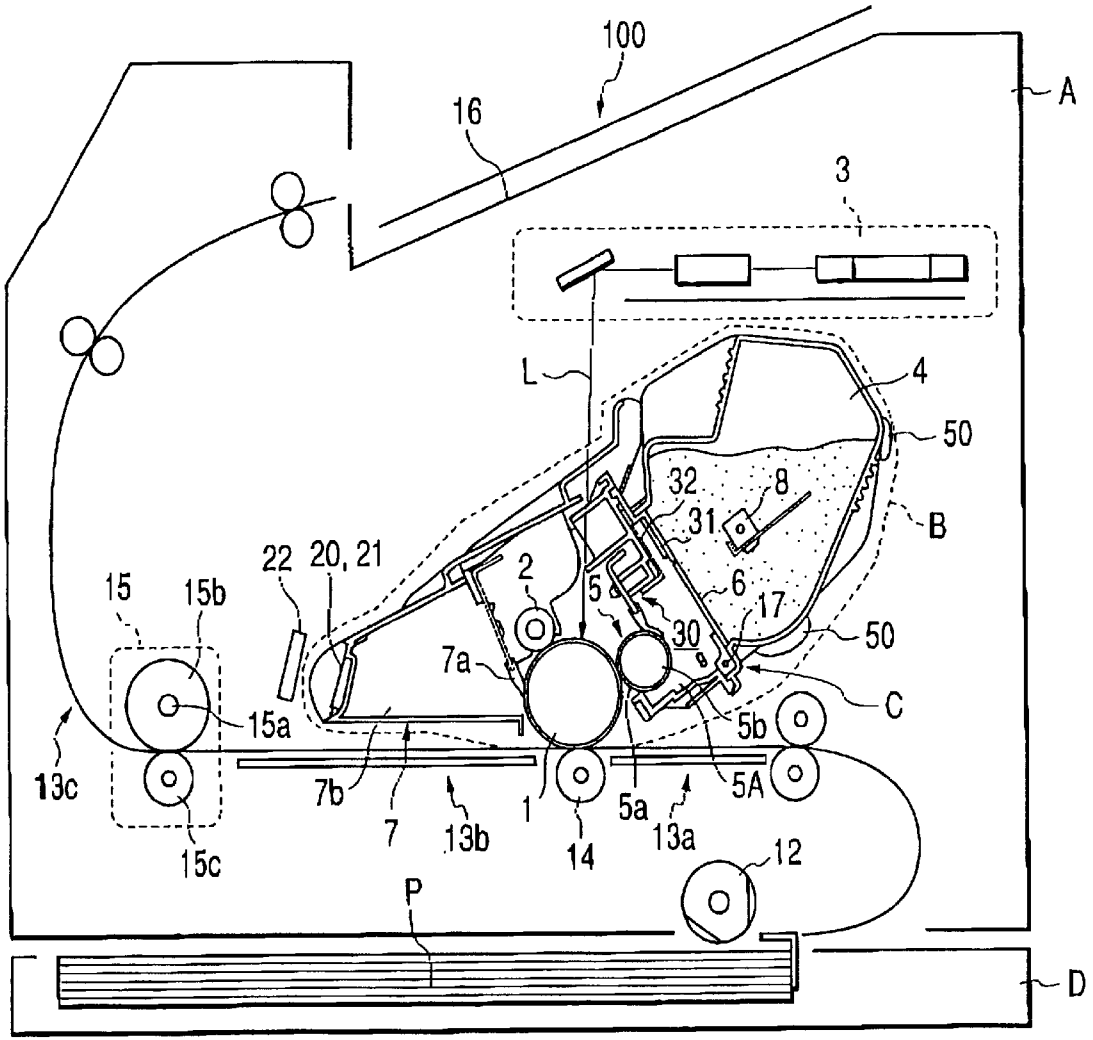
FIG. 1 is a cross-sectional view of an embodiment of a process cartridge and an image forming apparatus according to the present invention.
Figure 2:
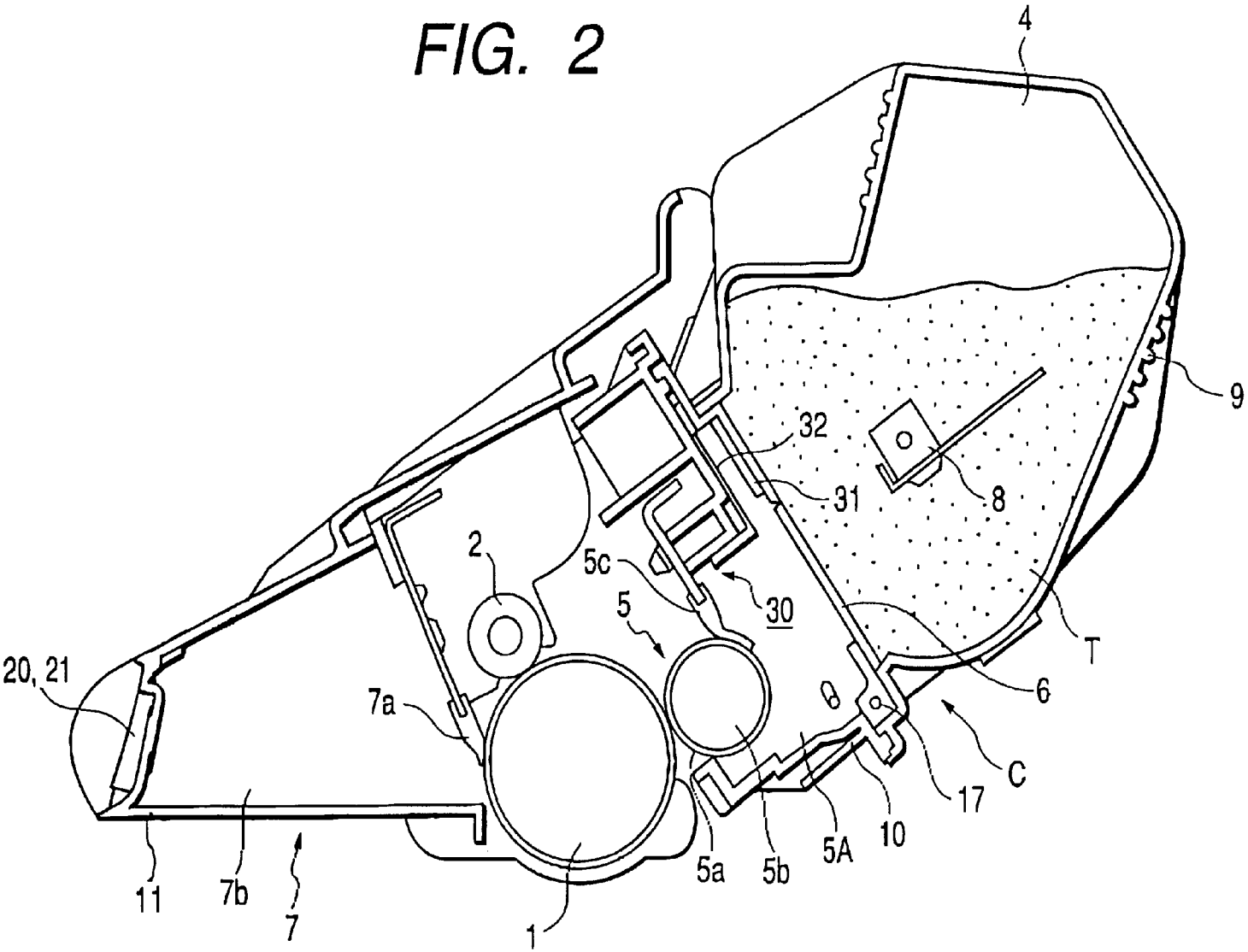
FIG. 2 is an enlarged cross-sectional view of the process cartridge of FIG. 1.

Reference is first had to FIGS. 1 and 2 to describe the printer 100 to which the process cartridge B constructed in accordance with the present invention is attachable. The printer 100 has a drum-shaped electrophotographic photosensitive body, i.e., a photosensitive drum 1. The photosensitive drum 1 is charged by a charging roller 2 which is charging means, and then is scanned by and exposed to a laser beam conforming to the image information applied from a laser scanner 3, whereby a latent image conforming to the image information is formed on the photosensitive drum 1. This latent image is developed by the developing means 5 of a developing apparatus C and is made into a visible image, i.e., a toner image. That is, the developing apparatus C has a developing chamber 5A provided with an electrically conductive roller 5*a* which is a developer carrying member, as a developer containing portion, and a developer containing container 4 formed adjacent to the developing chamber 5A, and a developer T in the developer containing container 4 moves to the developing chamber 5A and is supplied to the developing roller 5*a*. Agitating means 8 rotates and is provided in the developer containing container 4, and by this agitating means 8 being rotated, the developer T is loosened and is supplied to the developing roller 5*a*. In the present embodiment, an insulative magnetic monocomponent toner is used as the developer T. Also, the developing roller 5*a* contains a stationary magnet 5*b* therein, and by the developing roller 5*a* being rotated, the developer is carried, and triboelectric charges are imparted thereto by a developing blade 5*c* which is a developer layer thickness regulating member, and the developer is made into a developer layer of a predetermined thickness, and is supplied to the developing area of the photosensitive drum 1. The developer supplied to this developing area is shifted to the latent image on the photosensitive drum 1 to thereby form a toner image. The developing roller 5*a* is connected to developing bias applying means 33 (FIG. 3), and usually a developing bias voltage comprising a DC voltage superimposed upon an AC voltage is applied thereto.

On the other hand, in synchronism with the formation of the toner image, a recording medium P set on a feed cassette D is conveyed to a transferring position through the intermediary of a pickup roller 12 and conveying means 13*a*. A transferring roller 14 as transferring means is disposed at the transferring position, and by a voltage being applied thereto, the toner image on the photosensitive drum 1 is transferred to the recording medium P.

The recording medium P to which the toner image has been transferred is conveyed to fixing means 15 by conveying means 13*b*. The fixing means 15 is provided with a fixing roller 15*b* containing a heater 15*a* therein and a driving roller 15*c*, and applies heat and pressure to the passing recording medium P and fixes the transferred toner image on the recording medium P.

The recording medium P is discharged onto a discharge tray 16 by conveying means 13*c*. This discharge tray is provided on the upper surface of the main body A of the printer 100.

The photosensitive drum 1 after the toner image has been transferred to the recording medium P by the transferring roller 14 has any residual developer thereon removed by a cleaning apparatus 7, and thereafter is used for the next image forming process. The cleaning apparatus 7 scrapes off the residual toner on the photosensitive drum 1 by an elastic cleaning blade 7*a* as cleaning means provided in abutting relationship with the photosensitive drum 1 and collects it into a waste developer container 7*b*.

In the present embodiment, the process cartridge B, as shown in FIG. 2, comprises a developer frame 9 forming the developer containing container 4 provided with the agitating means therein and containing the developer therein, and a developing frame 10 forming the developing chamber 5A holding therein the developing means 5 including the developing roller 5*a* and the developing blade 5*c*, the developer frame 9 and the developing frame 10 being welded together as a unit to thereby form the developing apparatus (developing unit) C, and further, a cleaning frame 11 to which are attached the photosensitive drum 1, the cleaning apparatus 7 provided with the cleaning blade 7*a* and the waste developer container 7*b* and the charging roller 2 is integrally coupled to the developing apparatus C to thereby make a cartridge. This process cartridge B is detachably mounted with respect to cartridge mounting means 50 (FIG. 1) provided in the main body A of the image forming apparatus by the user. Also, a developer sealing member 6 is provided between the developer containing container 4 and the developing chamber 5A. This developer sealing member 6 is not unsealed until the process cartridge B is used, and although not restricted, in the present embodiment, it is automatically unsealed by automatic unsealing means 17 when the process cartridge B is mounted on the main body A of the image forming apparatus. The developer sealing member 6 may be one having structure mechanically brought down by a cam or the like or a seal member capable of being taken up.

The printer 100 of the present embodiment has a developer amount detecting apparatus provided with developer remaining amount detecting means 30 which can sequentially detect the remaining amount of the developer T in the developing apparatus C in accordance with the consumption thereof.

According to the present embodiment, a plate antenna type is used as the developer remaining amount detecting means 30. As shown in FIG. 2, as the plate antenna, a first metal plate 31 and a second metal plate 32 are provided over the substantially entire lengthwise area in the developing apparatus C. The second metal plate 32 is provided at a location opposed to the developing roller 5*a* substantially in parallel to the lengthwise direction thereof. Also, the first metal plate 31 is provided in opposed relationship with the second metal plate 32 and substantially in parallel with the lengthwise direction thereof. As described above, the first metal plate 31 and the second metal plate 32 are disposed in the developing apparatus C, and the capacitance between the developing roller 5*a* and the second metal plate 32 and between the first metal plate 31 and the second metal plate 32 changing with a decrease in the developer T in the developing apparatus C is observed, whereby the developer amount in the developing apparatus C can be known at any time.

For the first metal plate 31 and the second metal plate 32 as the plate antenna, any material which basically permits an electric current to flow therethrough can be used without particular restriction, but in the present embodiment, SUS which is strong against rust is used as the material. Also, in the present embodiment, the first metal plate 31 and the second metal plate 32 are provided in the developing frame 10 forming the developing chamber 5A.

Figure 3:
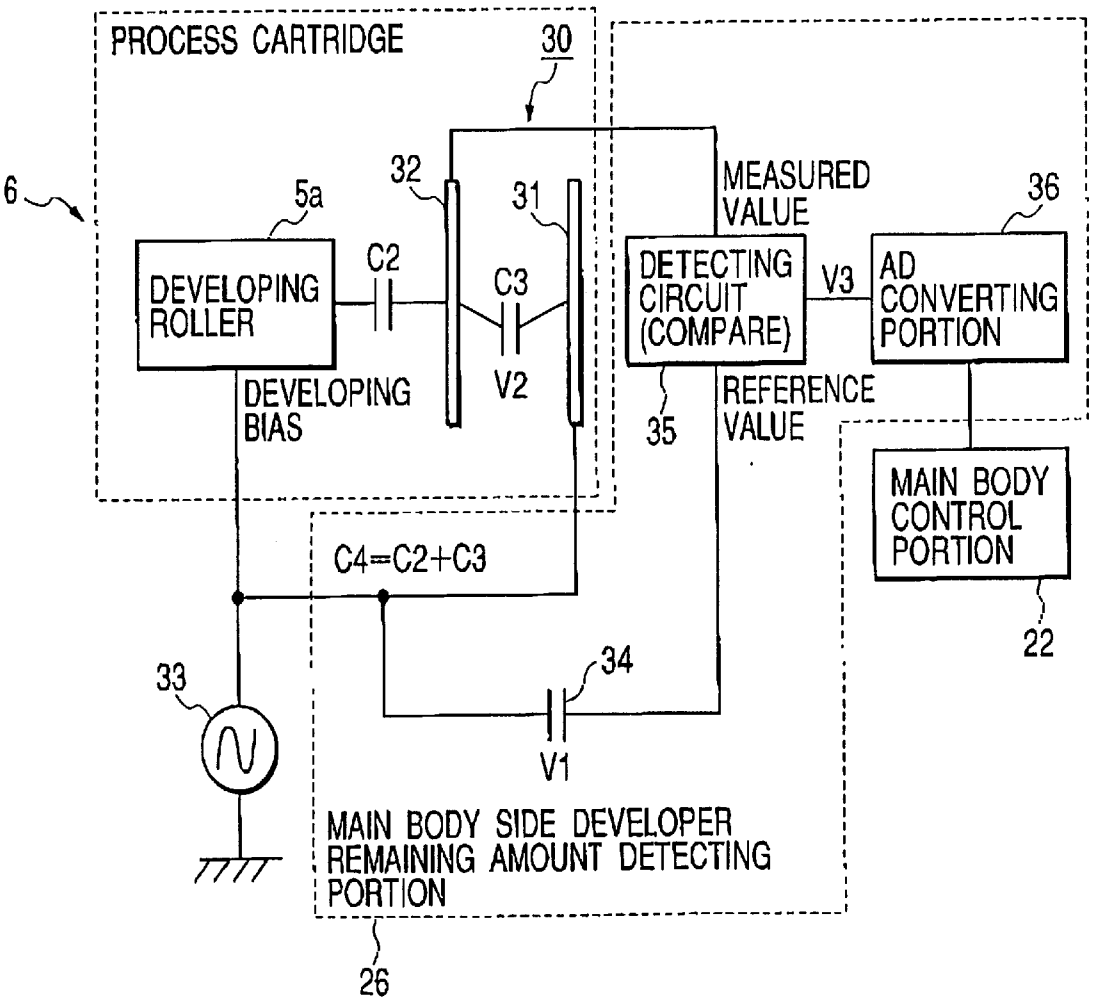
FIG. 3 shows the circuit construction of an embodiment of a developer amount detecting apparatus.

Describing the circuit construction of the developer amount detecting apparatus with reference also to FIG. 3, in the present embodiment, the is developing roller 5*a* and the first metal plate 31 are electrically connected to a developing bias circuit 33 which is developing bias applying means as voltage applying means provided in the main body A of the image forming apparatus, in a state in which the process cartridge B is mounted on the main body A of the image forming apparatus. An AC bias of about 2 KHz and a DC bias of about −400V which are ordinary developing biases are then applied to the developing roller 5*a* and the first metal plate 31.

When a predetermined AC bias is outputted from the developing bias circuit 33, the applied bias is applied to a capacitor 34 for reference. the developing roller 5*a* and the first metal plate 31. Thereby, a voltage V1 is produced across the capacitor 34 for reference, and an electric current conforming to the capacitance C2 between the developing roller 5*a* and the second metal plate 32 and the capacitance C3 between the first metal plate 31 and the second metal plate 32 is produced in the second metal plate 32. This current value is converted into a voltage V2 by calculation. Capacitance C4 is the composite capacitance of the capacitance C2 between the developing roller 5*a* and the second metal plate 32 and the capacitance C3 between the first metal plate 31 and the second metal plate 32.

In a main body side developer remaining amount detecting portion 26, a detecting circuit 35 produces a voltage V3 from the voltage difference between the inputted voltage V1 produced across the capacitor 34 for reference and the voltage V2 between the pair of metal plates, and outputs it to an AD converting portion 36. The AD converting portion 36 outputs the result of the analog voltage V3 having been digitally converted to a main body control portion 22.

A signal sequentially outputted by the developer remaining amount detecting means 30 through the second metal plate 32 in conformity with the capacitance (C2) between the developing roller 5*a* and the second metal plate 31 and the capacitance (C3) between the first metal plate 31 and the second metal plate 32 is simply called "the output (detected value) of the developer remaining amount detecting means", and the voltage value detected by the main body control portion 22 on the basis of the output of the developer remaining amount detecting means 30 is simply called "the detected voltage value V3".

In the main body control portion 22, as will be described later in detail, the developer remaining amount level is determined by the detected voltage value V3 converted into a digital value, by the use of an operating portion 24, control means 23 and a developer amount determining table (developer amount determining table storing portion) 25. In the present embodiment, the main body control portion 22 finds the developer remaining amount (g) on the basis of the detected voltage value V3, and makes display means 27 display the warning of e.g. "no developer" which informs the user of that information or that the developer has so much decreased that image formation of a predetermined quality is impossible.

Also, storing means 20 is provided in the process cartridge B of the present embodiment. As shown in FIGS. 1 and 2, in the present embodiment, the process cartridge B has on the side portion of the waste developer container 7*b* a memory 20 capable of reading and writing as the storing means 20, and a cartridge side transmitting portion 21 for controlling the reading and writing of information into this memory 20. When the process cartridge B is mounted on the main body A of the image forming apparatus, the cartridge side transmitting portion 21 and the main body control portion 22 provided in the main body A of the image forming apparatus are disposed in opposed relationship with each other. Also, it is to be understood that the main body control portion 22 has the function as the transmitting means of the apparatus 100 side.

In the present embodiment, the memory 20 is installed on the waste developer container 7*b* side, and this is with it taken into consideration that the process cartridge B is inserted into the main body A of the image forming apparatus with its waste developer container 7*b* side as the head and therefore it becomes easy to align the communication means of the memory 20 side and the main body A side of the image forming apparatus.

As the storing means 20 used in the present invention, use can be unlimitedly made of an electronic memory by an ordinary semiconductor such as a nonvolatile memory, or a combination of a volatile memory and a backup battery. Particularly, in the case of a non-contact memory which effects the data communication between the memory 20 and a reading/writing IC by an electromagnetic wave, the cartridge side transmitting portion 21 and the main body control portion 22 may be in non-contact with each other and therefore, the possibility of the bad contact due to the mounted state of the process cartridge B becomes null, and highly reliable control can be effected. In the present embodiment, a memory of the non-contact type is used as the storing means 20.

These two control portions, i.e., the main body control portion 22 and the transmitting portion 21 together constitute control means for effecting the reading and writing of the information in the memory 20. The capacity of the memory 20 can be a capacity sufficient to store a plurality of bits of information such as the used amount of the cartridge and the characteristic value of the cartridge. Also, the amount by which the cartridge has been used can be written into and stored in the memory 20 at any time.

Description will now be made of the principle of the detection of the developer amount using the developer remaining amount detecting means 30.

Figure 5:
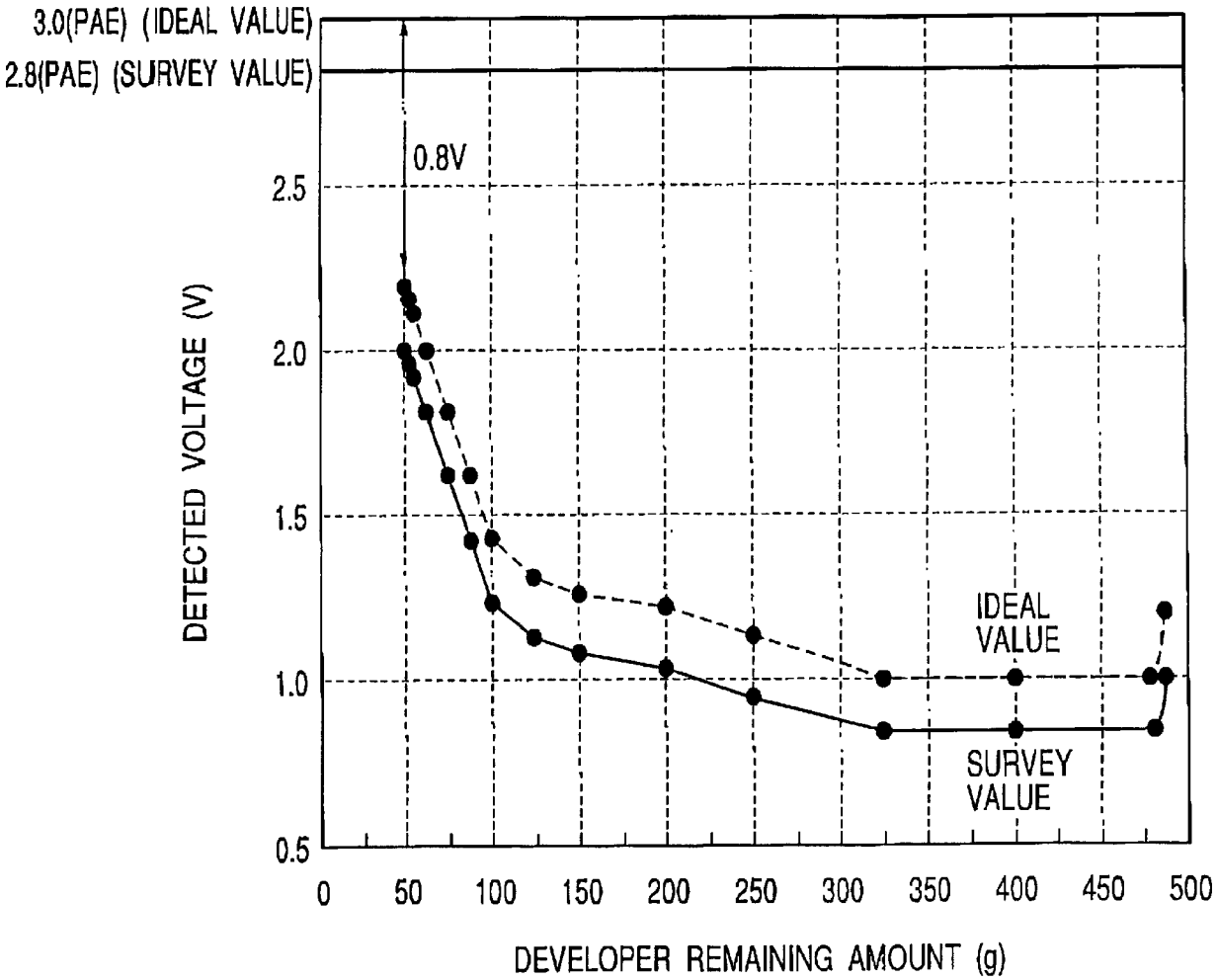
FIG. 5 is a graph showing the relation between the detected voltage value of the developer amount detecting apparatus and the developer remaining amount.

The capacitance value detected by the developer remaining amount detecting means 30 is converted into a voltage and is outputted at the detected voltage value V3 as shown in FIG. 5, and is detected in the main body A of the image forming apparatus.

In FIG. 5, the axis of ordinates shows the detected voltage value V3 corresponding to the totalled value of capacitance values C2 and C3 measured between the developing roller 5*a* and the second metal plate 32 as the developer remaining amount detecting means 30 and between the first metal plate 31 and the second metal plate 32, respectively, and the axis of abscissas shows the relation of the developer remaining amount in the developing apparatus C. Also, in FIG. 5, there are indicated the ideal curve (dotted line) of the detected voltage value by the developer amount detecting apparatus. and a survey value (solid line) which is an example in which the detected voltage value deviates from the ideal curve due to the individual difference of the process cartridge B or the image forming apparatus, as will be described later. In the present embodiment, from the connection of the converting circuit, like (capacitance, detected voltage)=(13 pF, 1.0V), (18 pF, 0.8V), the decrease and increase relation between the total capacitance between the developing roller 5*a* and the second metal plate 32 and between the first metal plate 31 and the second metal plate 32 and the detected voltage value V3 is in a converse relation, and when the capacitance is detected by the developer remaining amount detecting means 30, the detected voltage is set so as to be small when the capacitance is great, and so as to be great when the capacitance is small. Accordingly, when there is no developer in the developing chamber 5A, that is, when there is no developer between the developing roller 5*a* and the second metal plate 32 and between the first metal plate 31 and the second metal plate 32, the detected capacitance value indicates the minimum value and at this time, the detected voltage value V3 indicates the maximum value. The maximum value of the detected voltage value by the developer amount detecting apparatus is called "PAE value (plate antenna empty value)".

In the present embodiment, the developing roller 5*a* and the first and second metal plates 31 and 32 relatively proximate to the developing roller 5*a* are used as the developer remaining amount detecting means 30 and therefore, from the disposition relationship of the developer remaining amount detecting means 30, as shown in FIG. 5, from the point of time at which the developer in the developing apparatus C has been consumed to 325 g or less, an increase in the detected voltage value V3 (a decrease in the capacitance) begins, and thereafter, the decrease in the developer remaining amount within the range until the developer becomes exhausted can be sequentially detected. The present invention, however, is not restricted thereto, but it is also possible as a matter of course to adopt a construction in which as the plate antennae which are the developer remaining amount detecting means 30, an input side electrode and an output side electrode which are metal plates similar to the first and second metal plates in the present embodiment are provided at any locations in the developing apparatus, and the capacitance between the two electrodes is measured, whereby the range from a point of time at which the remaining amount of the developer is greater until the developer becomes exhausted can be sequentially detected.

In the developer remaining amount detecting means 30 of the plate antenna type, the capacitance between the developing roller 5*a* and the metal plate which is an electrode, or the capacitance between the metal plates which are electrodes is affected by the respective positional relations, and unevenness may occur to the detected voltage value due to the individual difference of the process cartridge even in a state in which there is no developer. Also, unevenness occurs to the detected voltage value from the manufacturing lot of the contained developer, the use environment, the positional deviation of the parts of the cartridge and the plate antennae, the tolerance of the electronic parts of the main body of the image forming apparatus, etc.

Thus, as shown in FIG. 5, the graph of the detected voltage V3 at the ideal value (dotted line) and the survey value (solid line) to the developer amount becomes a graph parallel-moved in the direction of the axis of ordinates by the difference of the PAE value. The data of the developer remaining amount and the detected voltage at the ideal value and the survey value in FIG. 5 are shown in Table 1 below.

TABLE 1

| developer remaining amount(g) | ideal value (V) | survey value (V) |
|---|---|---|
| 0 | | |
| 50 | 2.2 | 2.0 |
| 60 | 2.0 | 1.8 |
| 75 | 1.8 | 1.6 |
| 100 | 1.4 | 1.2 |
| 150 | 1.25 | 1.05 |
| 200 | 1.2 | 1.0 |
| 250 | 1.1 | 0.9 |
| 325 | 1.0 | 0.8 |
| 400 | 1.0 | 0.8 |
| 450 | 1.0 | 0.8 |

Like this, the detected voltage V3 deviates due to the individual difference of the process cartridge B or the main body A of the image forming apparatus by the causes as previously described and therefore, if the detection of the developer remaining amount level is effected on the basis of only the relation between the detected value of preset capacitance (detected voltage value V3) and the developer amount, there may arise the problem that the developer amount actually remaining in the developing apparatus C and the result of the detection widely differ from each other.

For example, when on the assumption that there is a risk of a state in which the entire image area cannot be visualized and a bad image is formed, i.e., the so-called blank, occurring at a point of time whereat the developer remaining amount has become 50 g, the warning of "no developer" is set so as to be given at a point of time whereat in the ideal curve (dotted line), the developer amount detecting apparatus has assumed the PAE value (3.0V) minus 0.8V, i.e., 2.2V, actually a blank image occurs at the detected voltage value of 2.0V (2.8 V (the PAE value of the survey value)−0.8= 2.0V), but yet there occurs a case where no warning is displayed until the detected voltage value becomes 2.2V, and an inconvenient image such as a blank image is outputted. As the result, it may lead to the user's claim.

The difference between the ideal value (dotted line) and the survey value (solid line) is the deviation of the PAE value, but strictly, it is the difference due to two factors, i.e., the main body A of the image forming apparatus and the process cartridge B. Accordingly, to detect the difference of the PAE value, the PAE value in the image forming apparatus being used must be detected. However, at a point of time whereat the process cartridge B has been inserted into the main body, the interior or the capacitor, i.e., the space between the developing roller 5*a* and the second metal plate 32 and between the first metal plate 31 and the second metal plate 32 is filled with the developer and the PAE value cannot be detected.

On the other hand, as can be seen from FIG. 5, as regards the detected voltage value V3 of the survey value (solid line), the developer remaining amount deviates by the difference (0.2V) between the detected voltage value of the ideal value (dotted line) and the PAE value at any point of time.

Accordingly, it is possible to detect, store and use the minimum value of the detected voltage value (which will hereinafter be called the PAF value: "plate antenna full value"), i.e., the detected voltage value V3 corresponding to the maximum value of the capacitance in a state in which the space between the developing roller 5*a* and the second metal plate 32 and between the first metal plate 31 and the second metal plate 32 is filled to maximum with the developer, to thereby know the deviation from the ideal value without using the PAE value.

That is, in the present embodiment, the following control is effected:

(1) The minimum value of the detected voltage value V3 detected in the main body of the image forming apparatus, i.e., the PAF value, is written into the storing means 20 provided in the process cartridge B;

(2) By the use of the PAF value stored in the storing means 20, the developer amount determining table 25 is utilized to find the developer remaining amount from an amount of change (V4) from the PAF value of the detected voltage value V3; and (3) The result is displayed on the display means 27 at any time.

Figure 4:
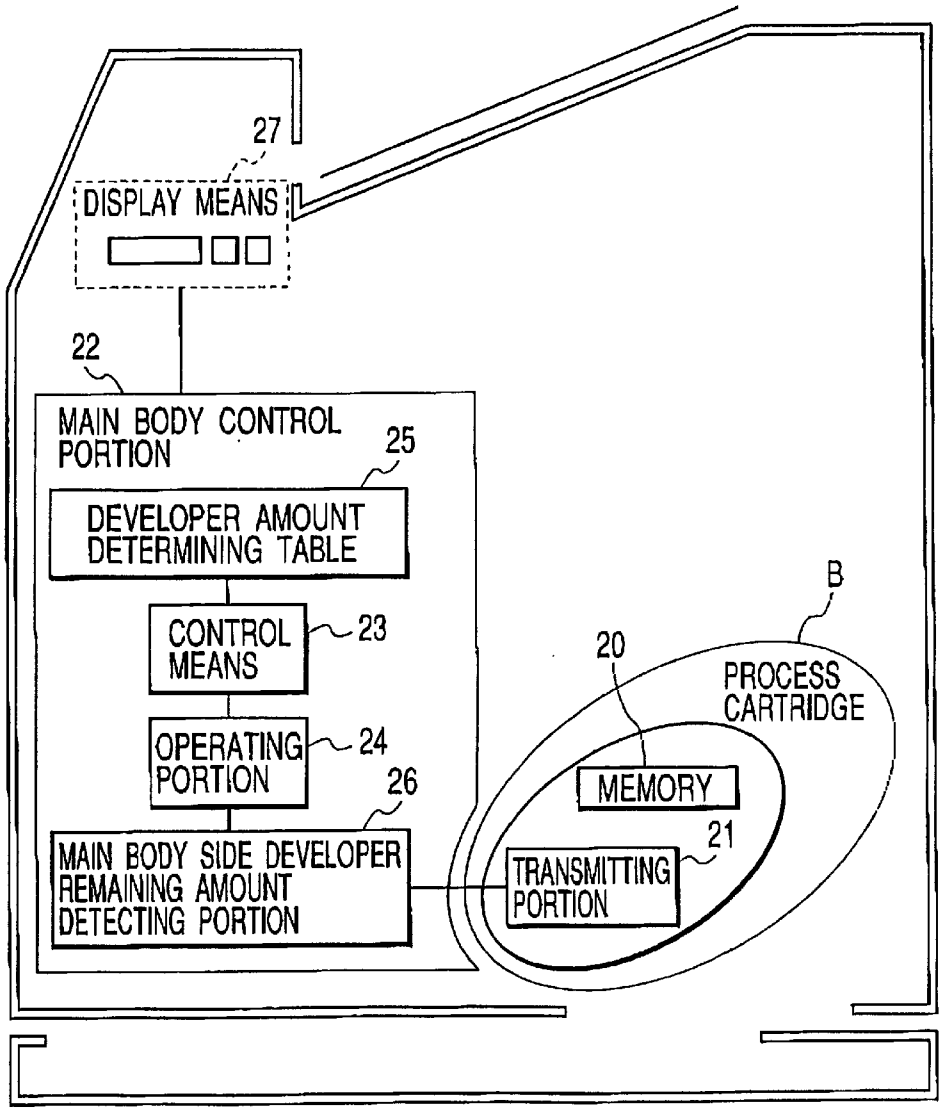
FIG. 4 schematically shows the relation between the cartridge and the main body of the image forming apparatus for illustrating an embodiment of the control construction of a memory provided in the process cartridge.

A control mechanism for the memory 20 in the present embodiment will now be described with reference to FIG. 4. As described above, the memory 20 and the cartridge side transmitting portion 21 are disposed on the process cartridge B side. Also, the main body control portion 22 is disposed on the main body A side of the apparatus, and it has the control means 23, the operating portion 24, the developer amount determining table (developer amount determining table storing portion) 25 and the main body side developer remaining amount detecting portion 26.

A signal from the developer remaining amount detecting means 30 is sent to the main body control portion 22 of the main body A of the image forming apparatus. The output signal from the developer remaining amount detecting means 30 is converted into a voltage signal by the main body side developer remaining amount detecting portion 26, and the operating portion 24 effects a predetermined operating process on the basis of this detection voltage signal and the information stored in the memory 20. Also, the control means 23 uses the developer amount determining table 25 to effect the checkup of the data obtained by the operating portion 24, thereby determining the developer remaining amount level. Further, in the present embodiment, the main body control portion 22 finds the developer amount Y (g) on the basis of the detected voltage value V3, and outputs a signal for making the display means 27 of the main body A of the apparatus display that information or the warning of "no developer".

Various kinds of information can be stored in the memory, and in the present embodiment, at least information corresponding to the developer amount (developer capacity) in the unused state of the process cartridge as the information regarding the process cartridge B which will be described later in detail, PAF value information and developer remaining amount Y (g) value information are stored therein.

Also, the information stored in the memory 20 is always capable of being transmitted to and received by the operating portion 24 in the main body control portion 22, and the checkup of the data operated on the basis of these bits of information is effected by the control means 23 on the basis of the information.

By the PAF value being stored in the memory 20 provided in the process cartridge B, even when for example, the process cartridge B being used is to be detached from the main body A of the image forming apparatus and be interchanged, the main body A of the image forming apparatus reads and uses the information stored in the memory 20 when thereafter this process cartridge is used again, whereby it is always possible to detect the developer remaining amount accurately in conformity with individual process cartridges B.

As means for relating the output of the developer remaining amount detecting means 30, i.e., in the present embodiment, the detected voltage value V3, and the developer amount to each other, the relation between the amount of change (V4) from the PAF value of the detected voltage value V3 and the developer remaining amount (g) in the developing apparatus C is stored in advance as the developer amount determining table 25 in the main body control portion 22.

In the present embodiment, on the assumption that a blank image may occur when the remaining amount of the developer in the developing apparatus becomes 50 g or less, the display of the warning of "no developer" is set so as to be effected.

By such control, the individual difference of the process cartridge B or the image forming apparatus can be absorbed and the sequential detection of the more accurate developer remaining amount can be effected.

However, when there is only one developer amount determining table 25, if use is made of a process cartridge B differing in the unused developer amount, the developer capacity, the detection accuracy of the developer remaining amount will lower. The reason for this will now be described. However, in order to simplify the description, a state in which there is not the unevenness of the detected value of the developer amount due to the use environment, the positional deviation of the parts of the process cartridge B and the plate antennae, and the tolerance of the electronic parts, etc. of the image forming apparatus is assumed. As described above, in the present embodiment, from the amount of change (V4) from the PAF value of the detected voltage value V3, the relation with the developer remaining amount (g) in the developing apparatus C is determined by the developer amount determining table 25.

Figure 6:
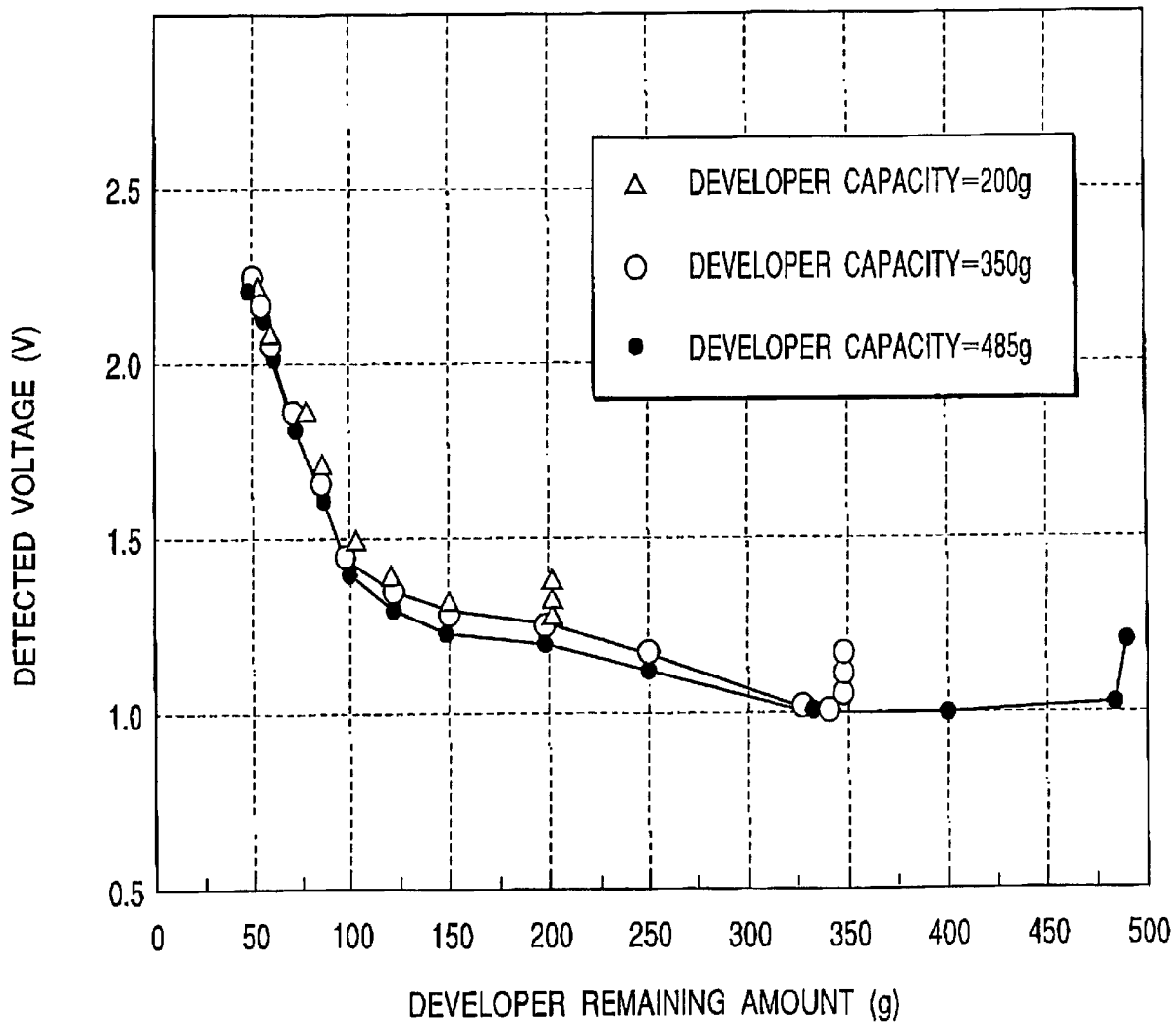
FIG. 6 is a graph showing the relation between the detected voltage value of a developer amount detecting apparatus in a process cartridge differing in developer capacity and the developer remaining amount.

FIG. 6 show the relations between the detected voltage V3 and the developer remaining amount when the developer capacity of the process cartridge B is 485 g, 350 g and 200 g. In any case, the detected voltage V3 is great in the full state of the developer, and this is because immediately after the developer sealing member 6 has been unsealed, the developer is not sufficiently sent from the developer containing container 4 into the developing chamber 5A and the developer does not sufficiently exist between the developing roller 5*a* and the second metal plate 32 and between the first metal plate 31 and the second metal plate 32. However, by image formation being effected, the developer agitating means 8 is driven and the developer is sent to between the developing roller 5*a* and the second metal plate 32 and between the first metal plate 31 and the second metal plate 32, whereby the detected voltage value V3 is saturated.

As shown in FIG. 6, when the developer capacity is 485 g and 350 g, the PAF value which is the minimum value of the detected voltage V3 is the same 1V. On the other hand, when the developer capacity is 200 g, the PAF value is 1.2V differing from the previous two.

In the present embodiment, the developer remaining amount is determined by the amount of change V4 from the PAF value of the detected voltage value V3 and therefore, if the PAF value differs, the value of the amount of change V4 will differ for the same detected voltage V3 and the detected value of the developer remaining amount will deviate greatly.

More specifically describing this phenomenon, Table 2 below is one in which the amount of change V4 and the developer remaining amount (g) are related to each other so that the display of the developer remaining amount display Y(g) may become optimum at the developer capacity 485 g.

TABLE 2

| developer remaining amount display Y (g) | V4 [V3-PAF] |
|---|---|
| toner low | 1.0 or greater |
| 75 | 0.8 to 1 |
| 100 | 0.4 to 0.8 |
| 150 | 0.25 to 0.4 |
| 200 | 0.2 to 0.25 |
| 250 | 0.1 to 0.2 |
| 250 or greater | 0 to 0.1 |

Assuming that this table is used in the case of a process cartridge B of the developer capacity 200 g, consider, for example, a case where the developer remaining amount is 100 g. At this time, the detected voltage V3 exhibits is 1.4V. When the developer capacity is 200 g, the PAF value is 1.2V and therefore, the value of the amount of change V4 is 0.2V (1.4V-1.2V). From Table 2, when V4 is 0.2V, the developer remaining amount display Y(g) exhibits 200 g, and displays a value greater than the actual developer amount. Therefore, when like this, the PAF value differs due to the developer capacity of the process cartridge B, it is necessary to change the developer amount determining table 25 in conformity therewith.

So, in the present embodiment, in conformity with the kind of the process cartridge B usable in the image forming apparatus, a table for a process cartridge B of which the developer capacity is 350 g and 485 g (Table 1) and a table for a process cartridge B of which the developer capacity is 200 g (Table 3) are used as the developer amount determining table 25.

TABLE 3

| developer remaining amount display Y (g) | V4 [V3-PAF] |
|---|---|
| toner low | 0.8 or greater |
| 75 | 0.6 to 0.8 |
| 100 | 0.2 to 0.6 |
| 150 | 0.05 to 0.2 |
| 200 | 0 to 0.05 |

That is, in the present embodiment, the developer capacity information of the process cartridge B stored in advance in the memory 20 provided in the process cartridge B is read on the main body A side of the image forming apparatus, and on the basis of that information, a table to be used is determined from a plurality of set developer amount determining tables 25. When the developer capacity is 350 g and 485 g, the table shown in Table 2 is used as the developer amount determining table 25, and when the developer capacity is 200 g, the table shown in Table 3 is used as the developer amount determining table 25.

In the present embodiment, these two tables are preset as the developer amount determining table (developer amount determining table storing portion) 25 in the main body control portion 22.

In the present embodiment, from the disposition relation of the developer remaining amount detecting means, the rise of the detected voltage V3 (the lowering of the capacitance) by the developer amount detecting apparatus begins from the developer remaining amount of the order of 325 g (usable developer amount 275 g) and therefore as the developer remaining amount display before that, it is possible to display, for example, "325 g or greater" or "100%". Also, for example, before the developer is decreased to such a degree that an image of a predetermined quality cannot be formed, the warning of "toner low" or the like may be displayed at a point of time whereat the amount of change V4 (V3-PAF) has assumed a predetermined value or greater.

Figure 7:
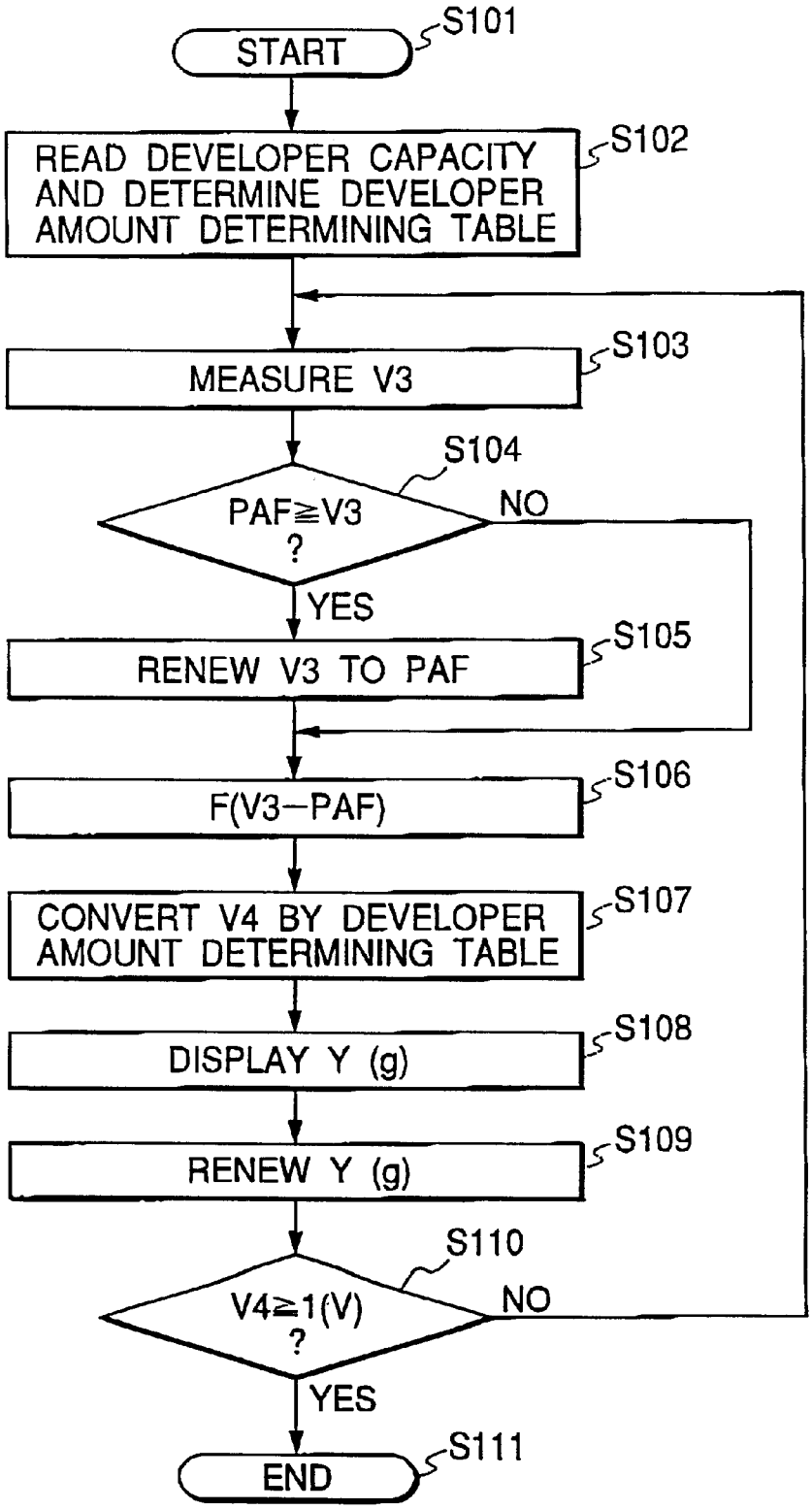
FIG. 7 is a flow chart for illustrating an embodiment of the developer amount detecting operation using the storing means of the cartridge according to the present invention.

The developer amount sequential detecting operation will now be described with reference to the flow chart (step (S) 101 to step (S) 111) of FIG. 7.

S101; The power supply of the main body A of the image forming apparatus is rendered ON.

S102: The developer capacity value stored in the memory 20 of the process cartridge B is read, and the developer amount determining table 25 used to detect the developer level Y(g) is determined.

S103: The main body side developer remaining amount detecting portion 26 measures the detected voltage value V3.

S104: The control means 23 compares the detected voltage value V3 with the PAF value stored in the memory 20 of the process cartridge B, and judges whether the detected voltage value V3 is equal to or less than the PAF value stored in the memory 20. If it judges "Yes", advance is made to S105. Also, if it judges "No", advance is made to S106.

S105: The detected voltage value V3 measured this time is stored as the PAF value in the memory 20 of the process cartridge B.

S106: The operating portion 24 calculates the amount of change V4 from the relation between the PAF value and the detected voltage value V3.

S107: The control means 23 checks up the calculated V4 by the developer amount determining table 25 selected and determined by the developer capacity of the process cartridge B.

S108: The control means 23 transmits a signal indicative of the developer remaining amount being Y(g) to the display means 27 of the main body A of the image forming apparatus, and that information is displayed on the display means 27.

S109: The control means 23 writes the detected developer remaining amount Y(g) value information into the memory 20 of the process cartridge B and renews it.

S110: The control means 23 confirms whether V4 has reached I(V), and if it judges "No", return is made to S103, where the above-described chart is repeated. Also, if it judges "Yes", advance is made to S111.

When by effecting the control according to the above-described flow chart, the developer remaining amount display resulting from the consumption of the developer was evaluated with respect to process cartridges B differing in developer capacity and in the PAE value and the PAF value, the sequential detection of the developer remaining amount, having absorbed the individual difference of the process cartridge B or the main body A of the image forming apparatus therein, is possible.

As described above, according to the present invention, a plurality of set developer amount determining tables are suitably selected and used even for a process cartridge B differing in developer capacity and the minimum value (PAF value) of the detected voltage value by the developer amount detecting apparatus, whereby the relation between the developer remaining amount and the capacitance (detected voltage) can be corrected in conformity with the process cartridge of individual developer capacity, and it is always possible to detect an accurate developer remaining amount.

Also, even when depending on the positional relation or the like of the developer remaining amount detecting means 30, the capacitance detected by the developer remaining amount detecting means in the absence of the developer differs from one cartridge to another, it is possible to correct the individual difference of the process cartridge B or the main body A of the image forming apparatus without using the PAE value, and accurately detect the remaining amount of the developer.

Embodiment 2

Figure 8:
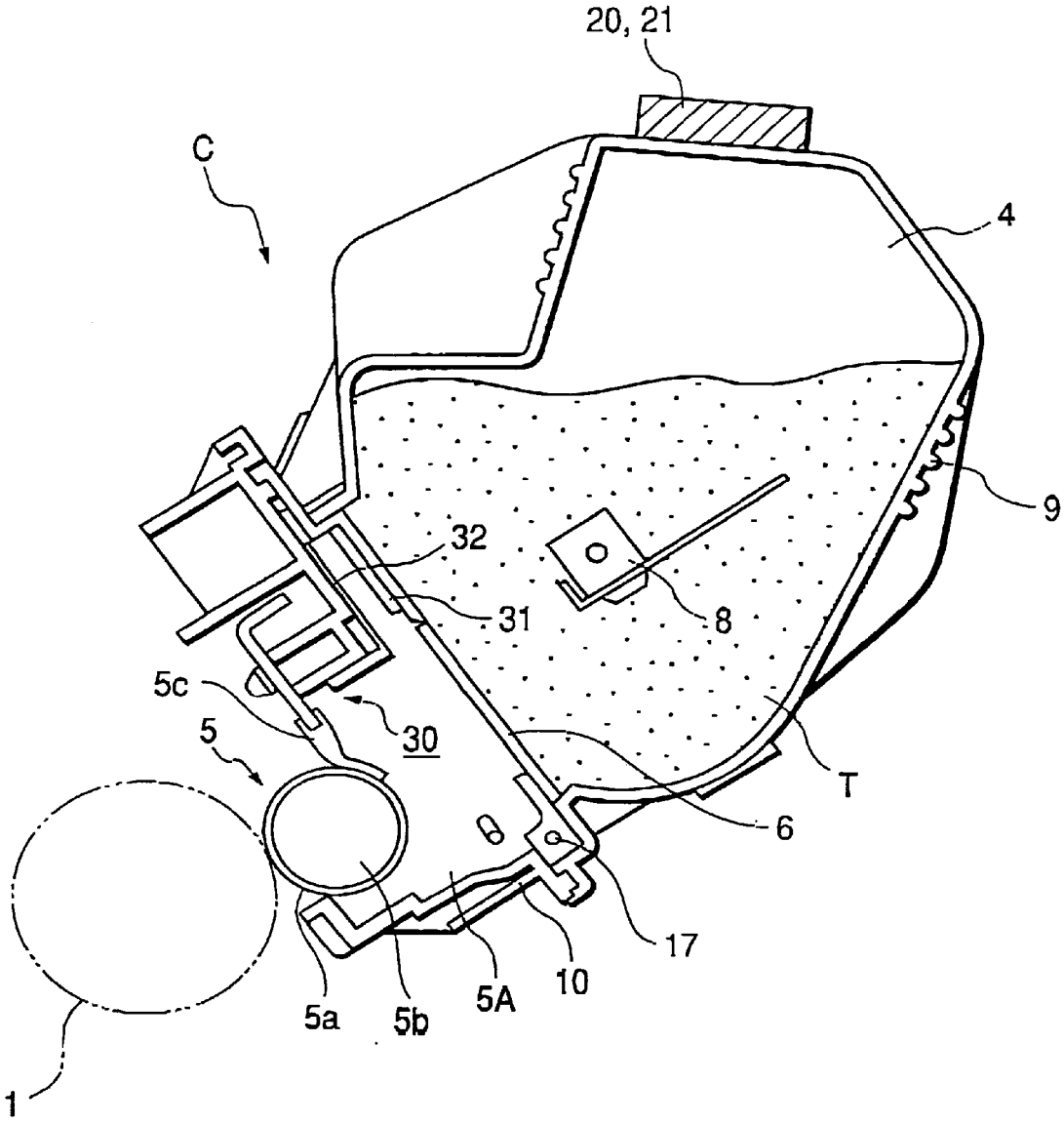
FIG. 8 is a cross-sectional view of an embodiment of a developing apparatus made into a cartridge according to the present invention.

FIG. 8 shows an embodiment of a developing apparatus C made into a cartridge which is an embodiment of the present invention. The developing apparatus C of the present embodiment is made into a cartridge by integrally constructing a developing chamber 5A holding therein developing means 5 such as a developing roller 5*a* and a developing blade 5*c* and a developer containing container 4 containing therein a developer to be supplied to the developing means 5 by a developer frame 9 and a developing frame 10 made of plastics. That is, the developing apparatus C of the present embodiment is a unit into which the developing apparatus constituting portion of the process cartridge B described in Embodiment 1 is made, and can be considered to be a cartridge into which the other parts of the process cartridge B than the photosensitive drum 1, the charging means 2 and the cleaning apparatus 7 have been integrally made. Accordingly, the constructions of all the developing apparatus constituting portion and the developer amount detecting apparatus described in Embodiment 1 are equally applied to the developing apparatus C of the present embodiment. Accordingly, the foregoing description made in Embodiment 1 is invoked for the description of these constructions and the action.

In the present embodiment, however, the memory 20 differs in that it is attached to the developer containing container 4. Again by the construction of the present embodiment, an operational effect similar to that of Embodiment 1 can be achieved.

As a matter of course, the relation between the developer remaining amount and the detected voltage value differs greatly depending on the construction of the cartridge, and particularly the construction and disposition of the developer remaining amount detecting means and therefore, the developer amount determining table is not restricted to that shown in Table 2 or Table 3, but can be suitably determined in conformity with the characteristics of the image forming apparatus and the cartridge carrying out the present invention. Also, while in each of the above-described embodiments, two developer amount determining tables have been set for process cartridge differing in the PAF value and the developer capacity, it is also of course possible to set a greater number of developer amount determining tables.

Also, while each of the above embodiments has been described with respect to a case where the decrease and increase relation between the capacitance detected by the developer remaining detecting means and the detected voltage finally detected by the developer amount detecting apparatus on the basis of the output of the developer remaining amount detecting means is set so as to become converse, this relation varies depending on the detecting circuit provided in the image forming apparatus, and the relation between the capacitance and the voltage may be the same decrease function or the same increase function.

The display of the developer remaining amount is not limited to being done by the display means provided in the main body of the image forming apparatus, but can also be done by display means which is the screen of an apparatus such as a host computer connected to the main body of the image forming apparatus for communication therewith.

Also, the method of declaring the developer remaining amount is not restricted to Y(g) in the above-described embodiments. For example, it is also of course possible to declare the remainder of the developer in terms of % such as the percentage of the developer to the so-called full tank, or the percentage of the currently usable developer to the developer usable in the unused state. As other displaying methods, use may be made of various displaying methods in a further advanced form, for example, a form displaying how more sheets can be outputted.

Also, the display by the display means is not limited to value display, but display may be done, for example, as a gas gauge type in which graduations are pointed to by a needle, or a bar graph type indicating by the length of an expansion bar. Further, it is also of course possible to inform the user of information regarding the remaining amount of the developer, such as the warning message of "no developer, by means of voice, or to record such information on a recording medium and output it, and use may be made of any display system by which the developer amount level can be known to the user.

While in each of the above-described embodiments, the plate antenna type is used as the developer remaining amount detecting means, the developer remaining amount detecting means of this type is not restrictive, but use may be made of any type if it can detect the developer amount level. Also, while in each of the above-described embodiments, the developer remaining amount detecting means is provided in the developing chamber, a plurality of developer remaining amount detecting means may be provided to improve accuracy, and there can also be adopted, for example, a construction in which the developer remaining amount detecting means is provided in the developer containing container, whereby the remaining amount of the developer is sequentially detected within the range from a state in which the developer is full until the developer is decreased to such a degree that images of a predetermined quality cannot be formed due to blank or the like.

While the invention has been described with reference to the structure disclosed herein, it is not confined to the details set forth and this application is intended to cover such modifications or changes as may come within the purposes of the improvements or the scope of the following claims.

What is claimed is:

1. An image forming apparatus to which is detachably attachable a cartridge having a developer containing portion and a developer amount detecting member configured and positioned to detect information regarding the developer amount in the developer containing portion, the cartridge being provided with a memory configured to store information regarding the developer amount of developer in the developer containing portion in an unused state of the cartridge, said apparatus comprising:

a main body having a control portion, said control portion having a plurality of determining means for determining the developer remaining amount, wherein said control portion selects one of said plurality of determining means according to the information stored in the memory, and wherein the control portion determines the developer remaining amount of remaining developer in the developer containing portion on the basis of the selected determining means and information regarding the developer amount detected by the developer amount detecting member.

2. An image forming apparatus according to claim 1, wherein said wherein said determining means comprises a table and the table is for making information regarding the developer amount detected by the developer amount detecting member and the developing remaining amount relate to each other.

3. An image forming apparatus according to claim 2, wherein the table relates information corresponding to the maximum of the developer amount detected by the developer amount detecting member and the developer remaining amount to each other and determining a shift value corresponding thereto.

4. An image forming apparatus according to claim 1, wherein the memory further stores information corresponding to the maximum of the developer amount detected by the developer amount detecting member or information regarding the determined developer remaining amount.

5. An image forming apparatus according to claim 1, wherein the developer amount detecting member outputs a signal obtained by measuring a capacitance between electrodes.

6. An image forming apparatus according to claim 1, wherein said main body of said apparatus further has display means, and transmits a signal for displaying information regarding the determined developer remaining amount to said display means, which displays the determined developer remaining amount thereon.

7. An image forming apparatus according to claim 1, wherein said main body of said apparatus is further capable of communicating with a device having display means, and transmits a signal for displaying the information regarding the determined developer remaining amount to the device having said display means.

8. An image forming apparatus according to claim 1, wherein the memory is a nonvolatile memory, a non-contact type nonvolatile memory, or a volatile memory provided with a power supply.

9. An image forming apparatus according to claim 1, wherein the cartridge further has at least one of an electrophotographic photosensitive body, charging means for charging the electrophotographic photosensitive body, developing means for supplying a developer to the electrophotographic photosensitive body, and cleaning means for cleaning the electrophotographic photosensitive body.

10. An image forming system for forming an image on a recording medium by use of a cartridge detachably attachable to a main body of an image forming apparatus, comprising:

(a) a cartridge having a developer containing portion, a developer amount detecting member configured and positioned to detect information regarding the developer amount in said developer containing portion, and a memory configured to store information regarding the developer amount of developer in said developer containing portion in an unused state of said cartridge; and (b) a control portion having a plurality of determining means for determining the developer remaining amount, wherein said control portion selects one of said plurality of determining means and determines the developer remaining amount of remaining developer in said developer containing portion on the basis of the selected determining means and information regarding the developer amount detected by said developer amount detecting member.

11. An image forming system according to claim 10, further comprising display means for displaying information regarding the detected developer amount.

* * * * *

UNITED STATES PATENT AND TRADEMARK OFFICE

CERTIFICATE OF CORRECTION

PATENT NO. : 6,668,141 B2
DATED : December 23, 2003
INVENTOR(S) : Katsuhiro Kojima et al.

It is certified that error appears in the above-identified patent and that said Letters Patent is hereby corrected as shown below:

Column 1,
Line 57, “expendibles” should read -- expendables --.

Column 4,
Line 27, “another” should read -- to another --.

Column 13,
Line 26, “amount,” should read -- amount, i.e., --.
Line 40, “show” should read -- shows --.

Column 17,
Line 18, “ “developer,” should read -- “developer,” --.

Column 18,
Line 2, “said wherein said” should read -- said --.
Line 10, “determining” should read -- determines --.

Signed and Sealed this

Thirteenth Day of July, 2004

JON W. DUDAS
*Acting Director of the United States Patent and Trademark Office*